United States Patent [19]

Barden

[11] 4,319,663

[45] Mar. 16, 1982

[54] PORTABLE SAWHORSE

[76] Inventor: Dan E. Barden, 161 S. Jefferson, Otisville, Mich. 48463

[21] Appl. No.: 152,331

[22] Filed: May 22, 1980

[51] Int. Cl.[3] ..... B27B 21/02

[52] U.S. Cl. ..... 182/154; 182/181; 182/225; 248/436; 248/459; 269/296; 269/254 R

[58] Field of Search ..... 182/154, 153, 181, 225; 248/459, 436; 269/296, 254

[56] References Cited

U.S. PATENT DOCUMENTS

| | | | |
|---|---|---|---|
| 591,096 | 10/1897 | Berbecker | 248/459 |
| 810,776 | 1/1906 | Lay | 182/154 |
| 1,604,254 | 10/1926 | Bate | 248/436 |
| 1,666,400 | 4/1928 | Rose | 248/459 |
| 2,507,620 | 5/1950 | Val Barbara | 248/459 |
| 2,733,740 | 2/1956 | Little | 269/296 |
| 3,034,546 | 5/1962 | Parsons | 182/153 |
| 3,148,746 | 9/1964 | Juculano | 182/153 |
| 4,113,056 | 9/1978 | De Lorenzo | 182/153 |

FOREIGN PATENT DOCUMENTS

| | | | |
|---|---|---|---|
| 446031 | 9/1912 | France | 182/153 |
| 18189 | of 1892 | United Kingdom | 248/436 |

*Primary Examiner*—Reinaldo P. Machado
*Attorney, Agent, or Firm*—Harry R. Dumont

[57] ABSTRACT

A sawhorse including a pair of V-cut-out or shaped side portions joined together by a vertical hinged portion. The sawhorse is openable for use and when folded side by side together can easily be carried.

8 Claims, 10 Drawing Figures

FIG. 1
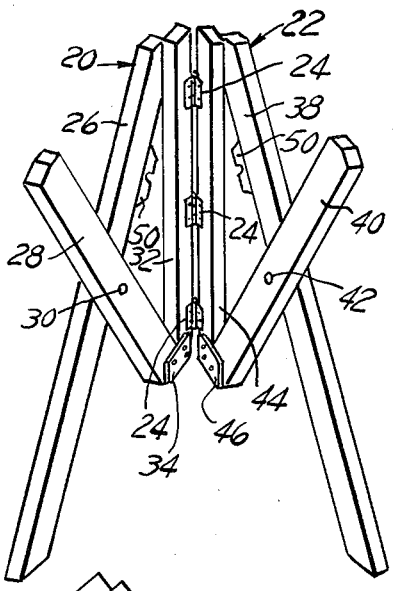
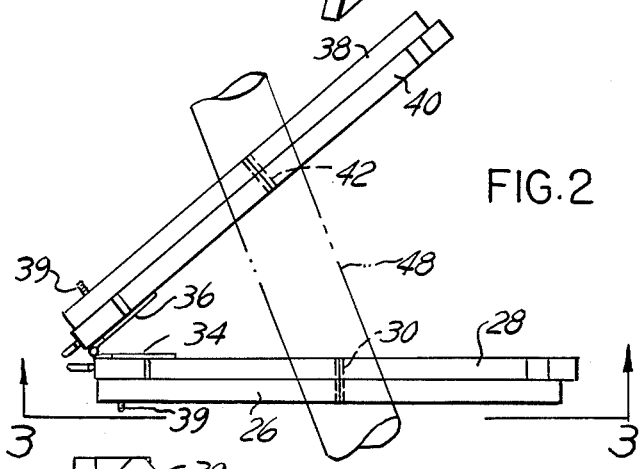
FIG. 2
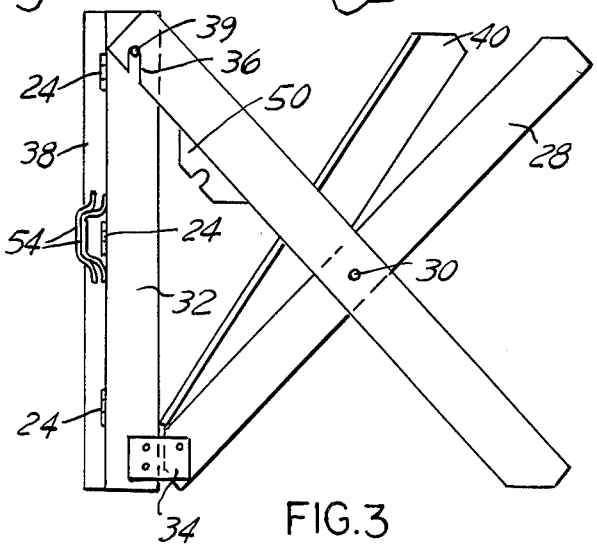
FIG. 3
FIG. 5
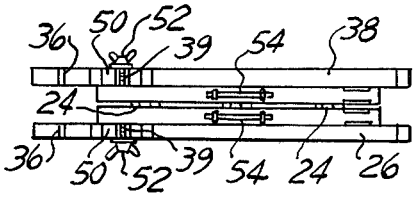
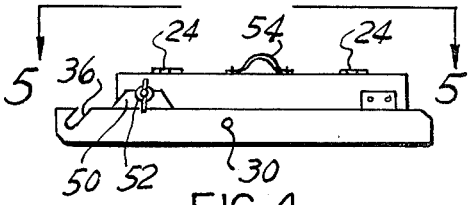
FIG. 4

FIG.6
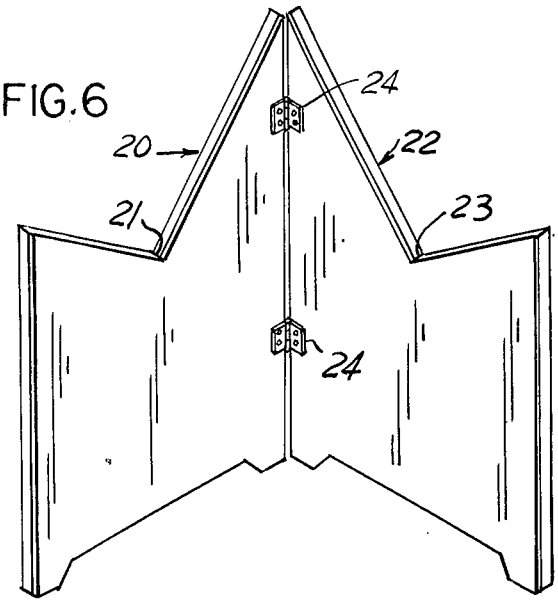
FIG. 7
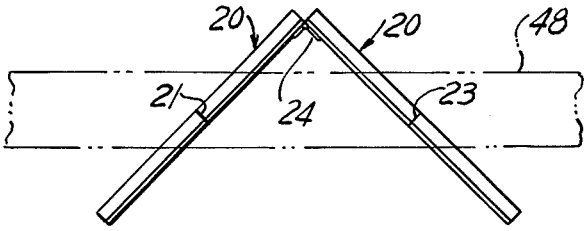
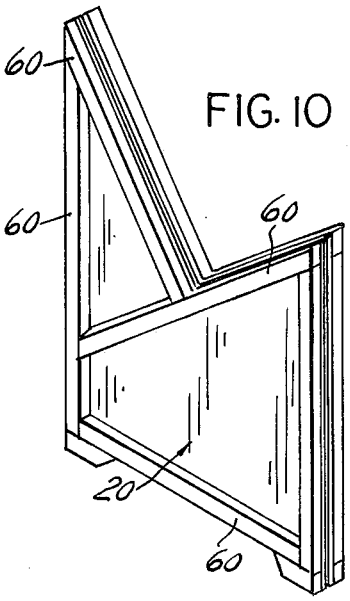
FIG. 10
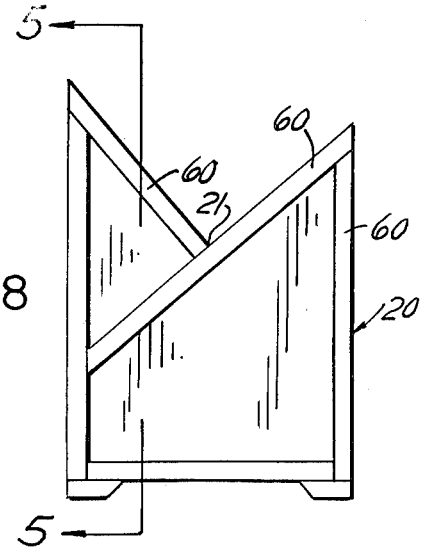
FIG.8
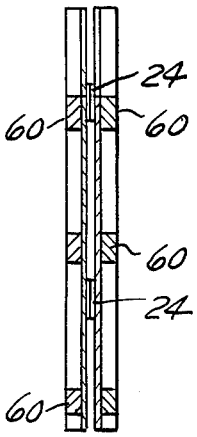
FIG.9

PORTABLE SAWHORSE

BACKGROUND OF THE INVENTION

A number of foldable sawhorses are known in the prior art in which the hinged portion forms an important part of the device and generally lies in an essentially horizontal plane. In an open position, the side portions are spread apart and their free ends rest on the ground. Examples of this type of sawhorse are shown and described in U.S. Pat. No. 4,113,056 issued to DeLorenzo on Sept. 12, 1978 and U.S. Pat. No. 3,148,746 issued to Juculano on Sept. 15, 1964. Other collapsible sawhorses are known of the type which are hinged at their centers and form, spaced apart, upwardly oriented V-shaped supports in the open position. One example of such a collapsible sawhorse is shown and described in U.S. Pat. No. 3,034,546 issued to Parsons on May 15, 1962.

Sawhorses which are both portable and easily collapsible for storage are particularly needed for cutting up firewood on site in the forest where windfalls or relatively long cut-off length logs are available. A substantial part of the work involved in removing logs from the woodlot is expended in transporting the log to an external location where it is sawed into fireplace length. Use of the present invention makes it possible to enter the woodlot with the sawhorse and to cut the logs into short, usable lengths which are also much more easily transportable from the wood lot.

The present invention meets a long existing need for the woodcutter and permits him to erect and make cuts on his sawhorse without having any parts of it in the path or sweep of the power saw. The manner in which my portable sawhorse is designed and operated makes possible several outside cuts and one inside cut without even moving the log from its initial position on the sawhorse.

BRIEF DESCRIPTION OF THE DRAWINGS

The several features and objects of the present invention and its advantages will appear from the accompanying specification and the drawings, in which:

FIG. 1 is a front perspective view of the invention in a partially opened position;

FIG. 2 is a top plan view of the device of FIG. 1 showing a log in phantom in place for cutting by the saw;

FIG. 3 is a side elevational view of the device of FIG. 1 along lines 3—3 showing one of the two side portions in anchored position.

FIG. 4 is a side elevational view of the device in its fully closed position for transport or storage;

FIG. 5 is a view along the line 5—5 of FIG. 4 showing further detail of the device;

FIG. 6 is a front elevational view of an alternate embodiment of my invention in which the side portions are of panel form;

FIG. 7 is a top plan view of the device of FIG. 6 in an opened, log bearing position;

FIG. 8 is a side elevational view of the device of FIG. 6;

FIG. 9 is a sectional view taken along the section line 9—9 of FIG. 8; and FIG. 10 is a perspective view of the device of FIG. 6 in its fully closed position for transport or storage.

DETAILED DESCRIPTION OF THE PREFERRED EMBODIMENT

FIG. 1 shows a preferred embodiment of my sawhorse in its open position ready to receive a log for cutting. The sawhorse includes two side portions 20 and 22. The side portions 20, 22 are joined along adjacent vertical edges by a plurality of hinges 24. The side portion 20 includes a pair of legs 26 and 28 which are pivotally joined near their midpoints by a pin 30. The side portion 20 also includes an upstanding or vertical member 32 to which is attached the hinges 24. It will further be seen that the leg 28 is pivotally connected on a hinged plate 34 to the lower end of the member 32. The other leg 26 includes a downwardly descending notched portion 36 engagable with a pin 38 laterally extending from the surface of the vertical member 32. In the opened and locked position of the sawhorse, the notch 36 is latched over the pin 39. In a like manner to the left side portion 20, the right side portion 22 includes a pair of legs 38, 40 pivotally connected near their midpoint by a pin 42. The hinges 24 which join the side portions together form a pivotal connection between the vertical member 32 and a corresponding vertical member 44 of side portion 22. A second lower hinge plate 46 is used to pivotally connect the bottom of the leg 40 to the member 44.

In the opened and operative position shown in FIG. 2, the log 48 is shown in phantom as it is seated in the V-shaped configuration formed in each of the side portions of each of the side members 20, 22, i.e., formed by their respective legs. Because of the V-shaped configuration, it is possible for the sawhorse to accomodate a broad size variation of logs for cutting. Also, by reason of the construction of the two side members 20, 22, there is no impediment to the passage of a saw into and through a log that is mounted in the sawhorse. Typically, in the use of a sawhorse, the cuts would be made on the outside of each of the side members 20, 22 and the final cut would then be made in the middle of the log halfway between the two side portions.

There exists the problem of moving the sawhorse through the underbrush of the woodlot or forest for use. This is largely overcome by the compact manner in which the sawhorse can be collapsed and readied for transport. FIGS. 1 and 3 also show the downwardly depending notch members 50 mounted on the underside of legs 26 and 38, respectively, for positioning about the pins 39 in the collapsed condition of the sawhorse. For the purpose of locking the device in its collapsed condition, the studs 39 are preferably threaded and adapted to receive wing nuts 52 to retain the legs in their closed position. Handles 54 are securely fastened to the outer surface of vertical members 32 and 44 for carrying.

FIG. 6 shows an alternate embodiment of my invention in which the side portions 20 and 22 are constructed of panel materials such as plywood or the like. The two side portions are joined by a plurality of hinges 24 in like manner to the embodiment of FIG. 1. The major difference between the two different embodiments is the manner in which the V-shaped configurations are provided in the two side members by cut-out portions 21 and 23, respectively. By reason of the separate leg construction of the FIG. 1 embodiment, the overall weight of the sawhorse is seen to be somewhat reduced as compared to the embodiment of FIG. 6.

FIG. 7 shows the manner in which a log 48 is mounted between the two side portions 20 and 22 in position for a sawing operation. Here, again, the end portions are first cut off and finally the center cut is made by the saw. FIGS. 8 and 10 show the manner in which bracing and rigidity are provided for the side portions 20 and 22 by a plurality of edge portions 60 mounted about the edges of each respective side portion. The resultant construction is a very rigid one capable of bearing relatively heavy logs for the cutting operation. In the folded position shown in FIGS. 9 and 10, the two side portions are brought face to face to form one flat package readily carried or stored.

It will thus be seen that by my invention I have provided an improved sawhorse, operational on the site for cutting firewood, easily transported to and from the site of use and further readily collapsible for storage.

I claim:

1. A foldable sawhorse including a pair of side portions, means for pivotally joining the two side portions along their respective vertical edges for folding;

said side members comprising in each case a flat planar member and a plurality of edge portions for bracing it;

said edge portions proximate the upper part of the side portions defining like V-shaped configurations for holding a log for a sawing operation;

said last-mentioned edge portions further including three reinforcing edge portions joined in a closed triangular relationship one to the other.

2. The combination as set forth in claim 1 wherein said means for pivotally joining said side portions comprises a plurality of vertically spaced hinges.

3. A portable sawhorse comprising a pair of side portions, said side portions pivotally connected along one adjacent vertical edge portion by a plurality of spaced hinges;

each of said side portions including a pair of legs pivotally connected one to the other proximate their midpoints;

the first of said legs pivotally attached at its bottom end to the vertical edge portion and the other attachable at its upper end to the vertical edge portion in an open locking position for woodcutting.

4. The combination as set forth in claim 3 wherein a notched portion is included proximate the upper end of each of said first legs cooperable with a respective stud extending from said vertical edge portion for locking said side portion in such open locking position for woodcutting.

5. The combination as set forth in claim 4 wherein said studs for locking are further engagable with a downward depending notched portion of such leg in a closed locking position for transport.

6. The combination as set forth in claim 5 wherein said studs are of the threaded type and a wing nut is used for fastening such legs of each respective side portion together in the closed locking position of the sawhorse.

7. The combination as set forth in claim 3 wherein a handle is fixed to the outer surface of at least one of said side portions for carrying in the closed locking position of the sawhorse.

8. The combination as set forth in claim 3 wherein said side portions are pivotally connected one to the other by a plurality of vertically spaced hinges.

* * * * *